US005452952A

United States Patent [19]

Grabher

[11] Patent Number: 5,452,952

[45] Date of Patent: Sep. 26, 1995

[54] DRAWER WITH INTEGRATED CONCEALED SLIDES AND BOTTOM

[75] Inventor: Guenter Grabher, Fussach, Austria

[73] Assignee: Grass AG, Hochst/Vlbg., Austria

[21] Appl. No.: 134,064

[22] Filed: Oct. 12, 1993

[30] Foreign Application Priority Data

Oct. 13, 1992 [DE] Germany ..... 9213778 U

[51] Int. Cl.[6] ..... A47B 88/00

[52] U.S. Cl. ..... 312/348.1

[58] Field of Search ..... 312/348.1, 348.2, 312/334.1, 330.1, 297

[56] References Cited

U.S. PATENT DOCUMENTS

| | | | |
|---|---|---|---|
| 3,556,626 | 1/1971 | Schock | 312/348.1 |
| 3,722,974 | 3/1973 | Hartman | 312/348.2 |
| 4,120,551 | 10/1978 | Godtschalck | 312/348.1 |
| 5,181,772 | 1/1993 | Albiez | 312/348.2 X |
| 5,221,134 | 6/1993 | Grass | 312/348.2 |

FOREIGN PATENT DOCUMENTS

| | | | |
|---|---|---|---|
| 1175092 | 9/1984 | Canada | 312/348.1 |
| 281766 | 9/1988 | European Pat. Off. | 312/348.1 |
| 567789 | 11/1993 | European Pat. Off. | 312/348.1 |
| 2312215 | 12/1976 | France | 312/348.2 |

*Primary Examiner*—Kenneth J. Dorner
*Assistant Examiner*—Robert J. Sandy

[57] ABSTRACT

A drawer with integrated concealed slides designed as side walls, utilizes a drawer bottom that is easily detached or inserted. The bottom is fastened with a catch fastening system on the integrated concealed slides.

5 Claims, 1 Drawing Sheet

DRAWER WITH INTEGRATED CONCEALED SLIDES AND BOTTOM

Figure 1:
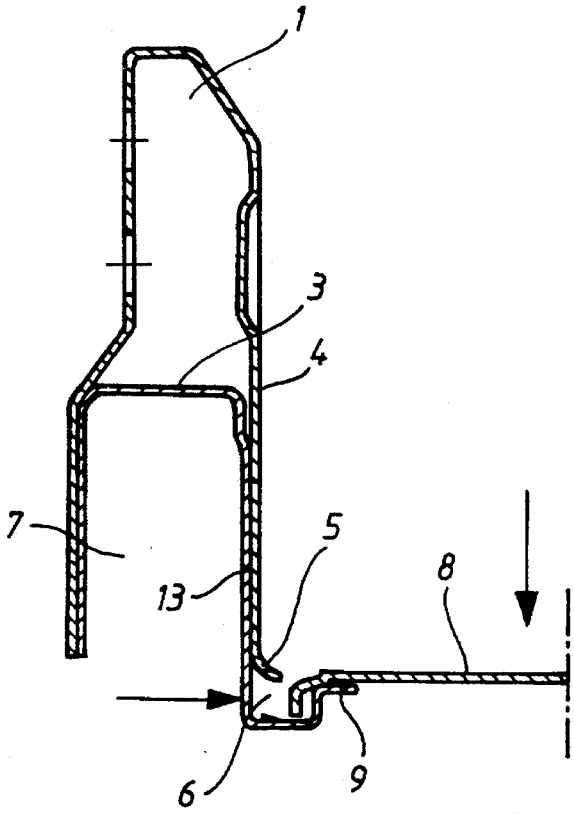

This innovation relates to a drawer with the integrated concealed slides formed as the side walls and an easily removable inserted drawer bottom to the principal concept of protection claim 1.

A drawer of this type was made known on the same previous application DE 39 42 897 A1.

In order to simplify transportation of these types of drawers, the drawers are sent in unassembled components, The snap-off detachable front drawer, the back wall, the integrated concealed slide side walls, and the drawer bottom are easily unassembled.

Near the stamped print, the drawer bottom is held, of course, by one of the upward open grooves of the integrated concealed slide side walls. Notwithstanding, the insertion of the drawer bottom ensues from the type of pivot bearing. That is, the integrated concealed slide drawer must be turned in relation to the fixed bottom in order to be installed.

The innovation forms the basis, therefore, to guarantee the simpler assembly of the disassembled components of the drawer.

The solution to the presented task of this innovation is explained by the technical precepts of claim 1.

The essential features of this innovation are that now the bottom can be connected quickly and easily to the side walls manually or with a drawer assembly press. This results, therefore, in catch connections; whereby, the upward open groove at the bottom and side walls of the integrated concealed slides are about half-way with a hollow chamber forming a second covered wall and a drawer bottom engages with both sides right-angled, downward to the curved support connection behind the catch nozzle in the groove base. The edges of the hollow chamber rest against the bottom non-positive and form-fitting so that they remain in the catch connection in the groove and are secured against removal from above.

The catch nozzles are designed as catch projections and lead from the groove base extruded lips, that are distributed from one another in intervals over the length of the groove.

The groove leads through a short, perpendicular support connection, which is defined on one side, on which it connects advantageously to a horizontal support connection on which the bottom's surface is adjacent.

The bottom area of the integrated concealed (side wall) slides' built hollow chambers form with the inner bottom surface a disengaged ledge change-over, while the bottom in this area display a ledge in which the front end of the hollow chamber is form-fitted.

Thereby, the risk of injury and the accumulation of dirt in the impact area of the bottom and side walls are extensively avoided. The utilized bottom in the preferred finished form is pulled up on the rear wall area and thus forms the rear wall and will be firmly fixed with the integrated concealed slides' side walls.

The invention's basis of the submitted innovation results from not only the matter of the particulars of the protection claims, but also the various combinations of the individual protection claims.

All records, documents and evidence, inclusive of the summary, open and disclosed statements and declarations, and indications and features, especially those represented embodiments in the drawings, will be claimed as fundamental and significant inventions, as far as the claims individually or in combinations are relative to the position that the technology is new.

The innovation at hand will be explained more precisely by the various explanations shown by the representational designs in the following. Hereby additional significant features and advantages of the innovation will be concluded from the designs and their descriptions.

Indicated:

FIG. 1: Section through the left side of a drawer with the bottom detached.

Figure 2:
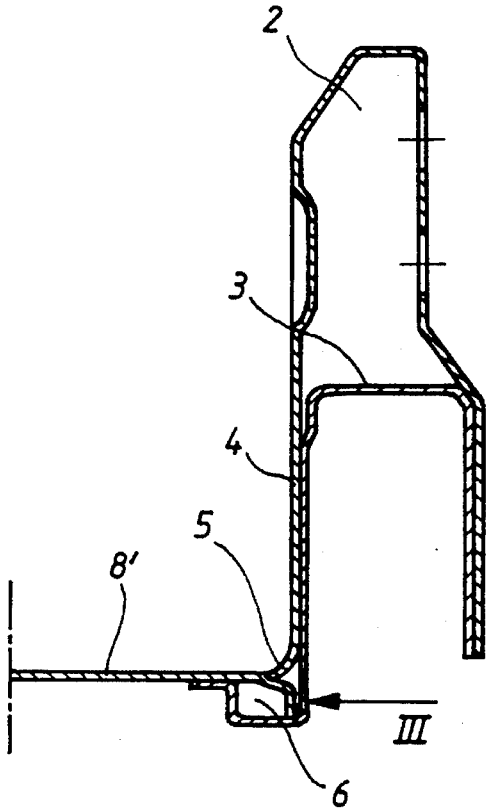

FIG. 2: Section through the right side of a drawer with attached bottom.

Figure 3:
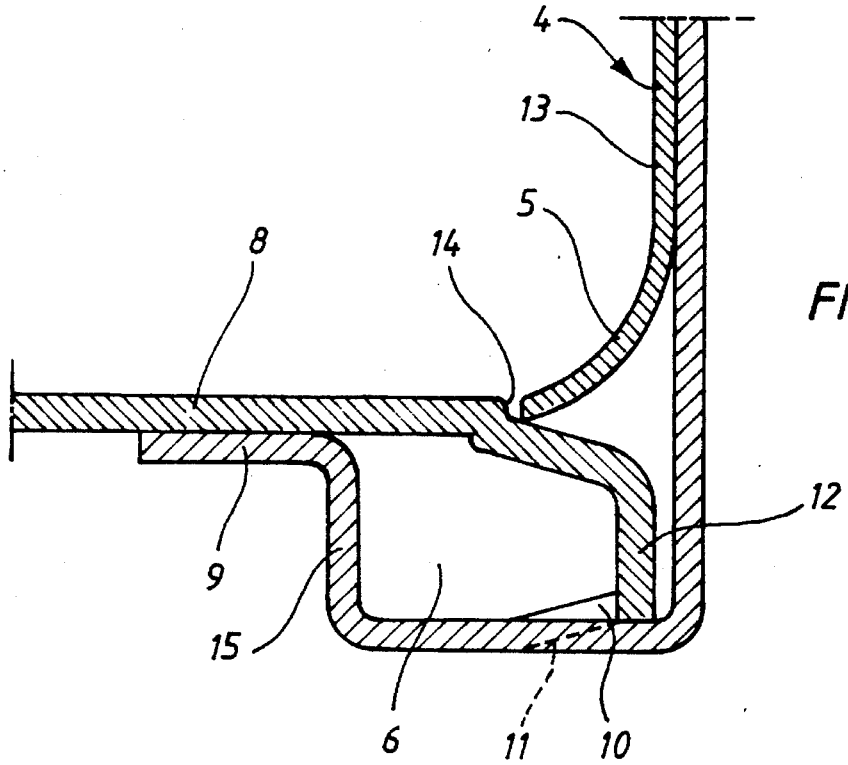

FIG. 3: A detail according to III in FIG. 2.

The side walls of the drawer are formed by the integrated concealed slides (1,2), thereby, the drawer is designed exactly mirror-symmetrical in relation to the lengthwise center axis.

On the basis the integrated concealed slides (1,2) on the left and right sides are designed exactly symmetrical. Therefore, it is sufficient from this point to detail only one side of the drawer in further descriptions.

The integrated concealed slides (1,2) are formed fundamentally from a hollow chamber profile in which a U-shaped flange (3) is inserted, which fits with an inner vertical support connection (13) against the side wall (4) of the integrated concealed slides (1,2). The flange (3) forms an inner reception space (7) in which a not closely described slide-glide system is admitted.

The flange (3) with a vertical support connection (13) forms an upward open groove (6). Thereby, the integrated concealed slide (1) side wall above the groove forms hollow chambers which project into the groove.

The bottom (8) engages with respective downward projecting vertical support connection (9) in this groove. Thereby, a groove base in conformity with figure (3) is respectively provided a catch projection (10), that is formed preferred as lip (11). The vertical support connections (12) of the bottom (8) are securely retained to prevent side shifting or displacement on the groove base of the groove (6).

The lips (11) also rest on the inner side of the bottom's vertical support connections (12). The catch fastening system is released in an unassembled state. The catch fastening system (according to FIG. 2) is engaged in the bottom in an assembled state.

The front side of hollow channel (5) fits non-positive and form-fitted against the ledge (14 ) of the drawer bottom (8), so that a stable, steady, continuous, unrestrained joined passage forms in this area.

The groove (6) will be defined in the remaining, respectively, inner sides of a short, vertical support connection (15), which joins the horizontal support connection (9). The fiat surface of bottom (8) rests on this support, connection so that the weight of the drawer's weight is distributed over the surface on the profile or side view of the integrated concealed slides (1,2).

DESIGN LEGEND

1. Integrated concealed slide
2. Integrated concealed slide
3. Flange
4. Side wall
5. Hollow chamber
6. Groove
7. Reception entrance space
8. Bottom
9. Support connection
10. Catch projection

11. Lips
12. Support connection (bottom 8)
13. Support connection (flange 3)
14. Ledge
15. Support connection

What is claimed is:

1. A drawer of the type having opposing sides, each defined by an integrated concealed slide, and an easily detachable drawer bottom, the drawer comprising:

a pair of integrated concealed slides, each defining a drawer side having an inner side wall and each having a bottom edge forming an upward opening groove; and a drawer bottom detachably engageable in the upward opening grooves of the respective integrated concealed slides, wherein the drawer bottom is provided with a vertically free downward sloped support connection which projects into the upward opening grooves of the respective integrated concealed slides, and each of the upward opening grooves has a base provided with an upward sloped catch projection which fits against the downward sloped support connection of the drawer bottom.

2. The drawer according to claim 1, wherein said upward sloped catch projection is provided with an extruded lip disposed on each of said upward opening groove bases.

3. The drawer according to claim 1 or claim 2, said inner side walls each having portions defining a rounded inward directed hollow channel which fits against said drawer bottom.

4. The drawer according to claim 3, wherein said inward directed hollow channel defining portions brace the drawer bottom against each of said upward opening groove bases.

5. The drawer according to claim 4, wherein each of said upward opening grooves is provided with a horizontally disposed support connection, and said drawer bottom fits upon said horizontally disposed support connections and is insertable into the upward opening grooves.

* * * * *